US007906908B2

(12) United States Patent
Choo

(10) Patent No.: US 7,906,908 B2
(45) Date of Patent: Mar. 15, 2011

(54) PLASMA DISPLAY PANEL (PDP)

(75) Inventor: Seong-Hun Choo, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 495 days.

(21) Appl. No.: 11/979,830

(22) Filed: Nov. 8, 2007

(65) Prior Publication Data

US 2008/0111487 A1 May 15, 2008

(30) Foreign Application Priority Data

Nov. 9, 2006 (KR) ..... 10-2006-0110723

(51) Int. Cl.
*H01J 17/49* (2006.01)

(52) U.S. Cl. ..... 313/586; 313/587

(58) Field of Classification Search ..... 313/582–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,309,992 | B1 | 10/2001 | Morita et al. | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,853,137 | B2 | 2/2005 | Asano et al. | |
| 7,323,819 | B2 | 1/2008 | Hong et al. | |
| 2003/0108753 | A1 * | 6/2003 | Fujii et al. | 428/469 |
| 2005/0042364 | A1 | 2/2005 | Lee | |
| 2005/0052138 | A1 * | 3/2005 | Kweon | 313/586 |
| 2006/0019814 | A1 * | 1/2006 | Baik et al. | 501/49 |

FOREIGN PATENT DOCUMENTS

CN 1641823 A 7/2005

(Continued)

OTHER PUBLICATIONS

The European search report dated May 15, 2009 of the corresponding EP Application No. 07254413.3.

(Continued)

*Primary Examiner* — Anne M Hines
(74) *Attorney, Agent, or Firm* — Robert E. Bushnell, Esq.

(57) ABSTRACT

A Plasma Display Panel (PDP) includes: a first substrate and a second substrate that are arranged in parallel with each other with a predetermined distance therebetween; a plurality of address electrodes arranged on the first substrate; a first dielectric layer arranged to cover the address electrodes; a plurality of barrier ribs having a predetermined height from the first dielectric layer to define discharge cells; red, blue, and green phosphor layers respectively arranged in the discharge cells; a plurality of display electrodes arranged on one side of the second substrate facing the first substrate in a direction crossing the address electrodes; a second dielectric layer arranged to cover the display electrodes; and a protective layer arranged to cover the second dielectric layer. The second dielectric layer satisfies values of CIE L*a*b* where $70.0<L^*<74.5$, $0.0<a^*<1.0$, and $-5.0<b^*<-8.0$.

11 Claims, 4 Drawing Sheets

FOREIGN PATENT DOCUMENTS

| | | | |
|---|---|---|---|
| CN | 101430994 | B | 11/2010 |
| EP | 1612193 | A | 4/2006 |
| JP | 2845183 | | 10/1998 |
| JP | 2917279 | | 4/1999 |
| JP | 11-354036 | | 12/1999 |
| JP | 2001-043804 | | 2/2001 |
| JP | 2001-325888 | | 11/2001 |
| KR | 10-2003-0045328 | | 6/2003 |
| KR | 10-2005-0019289 | | 3/2005 |
| KR | 10-2005-0041718 | | 5/2005 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner $L^*$ : light/dark $\qquad$ $L^* : 116(Y/Y_n)^{1/3} - 16$ $a^*$ : red(+)/green(-) $\qquad$ $a^* : 500[(X/X_n)^{1/3} - (Y/Y_n)^{1/3}]$ $b^*$ : yellow(+)/blue(-) $\qquad$ $b^* : 200[(Y/Y_n)^{1/3} - (Z/Z_n)^{1/3}]$

PLASMA DISPLAY PANEL (PDP)

CLAIM OF PRIORITY

This application makes reference to, incorporates the same herein, and claims all benefits accruing under 35 U.S.C. §119 from an application for PLASAMA DISPLAY PANEL earlier filed in the Korean Intellectual Property Office on 9 Nov. 2006 and there duly assigned Serial No. 10-2006-0110723.

BACKGROUND OF THE INVENTION

1. Field of the Invention

The present invention relates to a Plasma Display Panel (PDP). More particularly, the present invention relates to a PDP that prevents a halation effect and deterioration in brightness, decreases external light reflection brightness, and improves a bright room contrast ratio to thereby realize a high-quality image.

2. Description of the Related Art

A Plasma Display Panel (PDP) is a flat display device using a plasma phenomenon, which is also called a gas-discharge phenomenon since a discharge occurs in the panel when a potential greater than a certain level is supplied to two electrodes separated from each other under a gas atmosphere in a non-vacuum state.

The PDP should have a high contrast ratio, and it is desirable that the PDP does not reflect external light.

Among the methods developed in consideration of the required properties are a method of forming black stripes along a non-discharge area of the PDP, a method of coloring a transparent dielectric layer covering the electrodes formed in a front substrate, and a method of coloring the dielectric layer covering the address electrodes of a rear substrate black.

However, the methods of optionally shielding or coloring part of the PDP not only reduce reflection of external light but also block light emitted from the inside of the PDP to thereby deteriorate color purity and bright room contrast ratio, which is undesirable.

Moreover, when the PDP is optionally colored, the color representation on the display surface becomes blurry, which is a larger problem than the external light reflection. Therefore, the conventional methods have a problem in that they reduce the brightness and/or the bright room contrast ratio of the PDP overall.

Another conventional method suggests increasing the line width of the black stripes to improve the bright room contrast ratio and thus increase a black part ratio. The method, however, brings about a drastic deterioration in the brightness of the PDP, causes blots on the dielectric layer of an upper substrate, and makes it difficult to design a cell structure.

SUMMARY OF THE INVENTION

An exemplary embodiment of the present invention provides a Plasma Display Panel (PDP) that prevents a halation effect and reduction in brightness, decreases external light reflection brightness, and improves a bright room contrast ratio to thereby realize a high-quality image.

According to one embodiment of the present invention, a Plasma Display Panel (PDP) is provided, which includes: a first substrate and a second substrate that are arranged in parallel with each other with a predetermined distance therebetween; a plurality of address electrodes arranged on the first substrate; a first dielectric layer arranged to cover the address electrodes; a plurality of barrier ribs having a predetermined height from the first dielectric layer to define discharge cells; red, blue, and green phosphor layers respectively arranged in the discharge cells; a plurality of display electrodes arranged on one side of the second substrate facing the first substrate in a direction crossing the address electrodes; a second dielectric layer arranged to cover the display electrodes; and a protective layer arranged to cover the second dielectric layer. The second dielectric layer satisfies values of CIE L*a*b* where $70.0<L^*<74.5$, $0.0<a^*<1.0$, and $-5.0<b^*<-8.0$.

According to another embodiment, the second dielectric layer includes a mother glass, which is a glass powder composition, and a coloring pigment, and thereby satisfies the above-noted CIE L*a*b* values.

The coloring pigment is included in an amount in a range of 1.0 to 2.0 wt % based on the total weight of the dielectric layer, and is at least one oxide selected from the group consisting of $Mn_2O_3$, NiO, CoO, CuO, and combinations thereof. According to another embodiment, the coloring pigment includes 0.27 to 0.35 wt % of $Mn_2O_3$, 0.07 to 0.15 wt % of NiO, 0.45 to 0.65 wt % of CoO, and 0.15 to 0.35 wt % of CuO.

The glass powder composition includes 0.5 to 1.5 parts by weight of $SiO_2$, 15 to 18 parts by weight of $B_2O_3$, 3 to 5 parts by weight of $Al_2O_3$, 40 to 43 parts by weight of $Bi_2O_3$, 13 to 16 parts by weight of BaO, and 20 to 23 parts by weight of ZnO.

The barrier ribs satisfy values of CIE L*a*b* where $40<L^*<50$, $1.0<a^*<2.0$, and $1.0<b^*<3.0$.

The glass powder composition for forming the barrier ribs is not limited to that described above, and may include a generally-used white barrier rib forming composition. The coloring pigment for the barrier ribs may be selected from the group consisting of $TiO_2$, $MnO_2$, $SbO_2$, $(Ti, Mn, Sb)O_2$, $(Cu, Cr)O_2$, and combinations thereof. The coloring pigment may be included in an amount less than or equal to 1 wt % based on the total weight of the barrier ribs. According to another embodiment, the coloring pigment may be included in an amount in a range of 0.1 to 1.0 wt % based on the total weight of the barrier ribs.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

An exemplary embodiment of the present invention is described in detail hereinafter with reference to the accompanying drawings.

The present invention prevents a reduction in brightness of a PDP and a halation effect in which light is diffused by an optimal second dielectric layer whose brightness and color tone are optimized. When brown barrier ribs are used, the PDP has reduced external light reflection and an improved bright room contrast ratio due to the complementary color relationship between the second dielectric layer and the barrier ribs.

Figure 1:
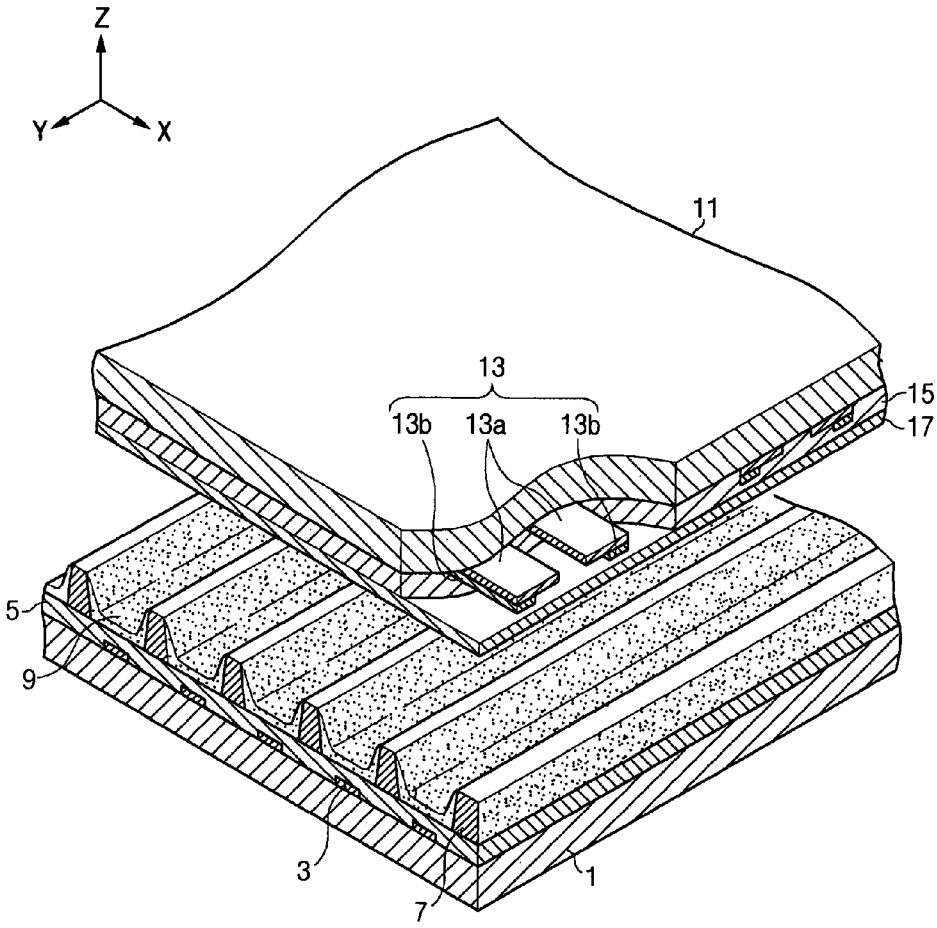
FIG. 1 is a partially exploded perspective view of a PDP in accordance with an embodiment of the present invention.

FIG. 1 is a partially exploded perspective view of a PDP in accordance with an embodiment of the present invention. However, the present invention is not limited to the structure of FIG. 1.

Referring to the drawing, the PDP includes a first substrate, which is a rear substrate 1, and a second substrate, which is a front substrate 11.

On the surface of the first substrate 1, a plurality of address electrodes 3 are disposed in one direction (the Y direction in the drawing), and a first dielectric layer 5 is disposed covering the address electrodes 3.

Barrier ribs 7 are formed on the first dielectric layer 5, and red (R), green (G), and blue (B) phosphor layers 9 are disposed on a bottom surface and sides of discharge cells formed between the barrier ribs 7.

Display electrodes 13, each including a pair of a transparent electrodes 13*a* and a bus electrode 13*b*, are disposed in a direction crossing the address electrodes 3 (the X direction in the drawing) on the side of a second substrate 11 facing the first substrate 1.

One of a pair of the display electrodes 13 is a sustain electrode (X electrode) and the other is a scan electrode (Y electrode). Discharge cells are formed at positions where the address electrodes 3 are crossed by the display electrodes 13.

A second dielectric layer 15 and a protective layer 17 are sequentially disposed to cover the display electrodes 13 on the second substrate 11.

With the above-described structure, an address discharge is performed by supplying an address voltage (Va) to a space between the address electrodes 3 and any one display electrode 13. When a sustain voltage (Vs) is supplied to a space between a pair of display electrodes 13, vacuum ultraviolet rays generated by the sustain discharge excite a corresponding phosphor layer 9 to thereby emit visible light through the transparent second substrate 11.

Since each constituting element of the PDP having the above-mentioned structure and a method of manufacturing the same are well known to those skilled in the art, a detailed description thereof is not presented.

The present invention uses brown-colored barrier ribs as a panel member of the first substrate 1 and a blue-colored second dielectric layer as a panel member of the second substrate 11 in the PDP. The PDP of the present embodiment reduces light reflection and improves the bright room contrast ratio by maximizing the complementary color relationship based on subtractive color mixing.

Figure 2:
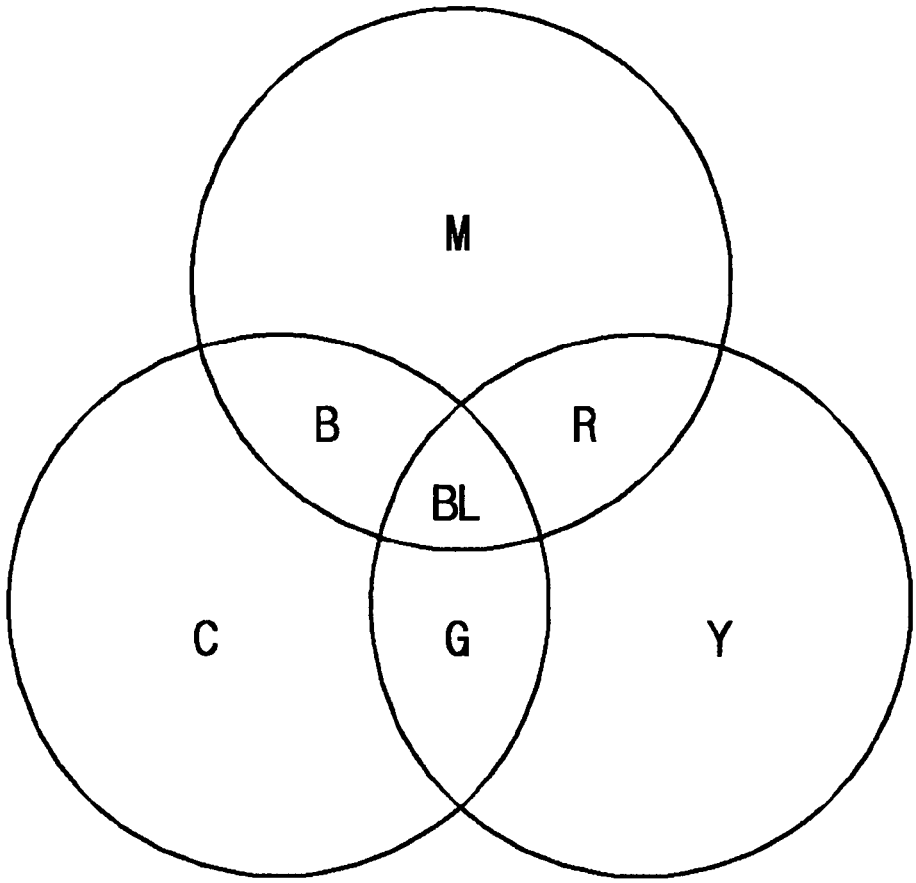
FIG. 2 is a view to explain subtractive mixing of colors.

FIG. 2 is a view for explaining subtractive mixing of colors.

The subtractive color mixing is a method of forming a color by adding any one color element to white. The three primary colors are magenta, yellow, and cyan. When two colors of a complementary relationship are mixed together, the resultant color becomes an achromatic color, e.g., gray or black. Non-limiting examples include a combination of red and cobalt and a combination of green and orange. A combination includes mixing any one among the three primary colors, and there are countless combinations of complementary colors.

The more subtractive colors are mixed, the more the lightness and chrominance are reduced. A mixture of adjacent color circles produces a neutral tint, and a mixture of distant color circles produces reduced lightness and chrominance close to grey. A mixture of complementary colors produces a color close to black.

In the embodiment of the present invention, the mixing ratio of the second dielectric layer and the barrier ribs 7 is controlled to achieve appropriate CIE L*a*b* values based on the subtractive mixing.

The CIE L*a*b values are obtained by quantitatively evaluating colors developed by the Commission International de I'Eclairage (CIE) or the International Commission on Illumination.

Figure 3:
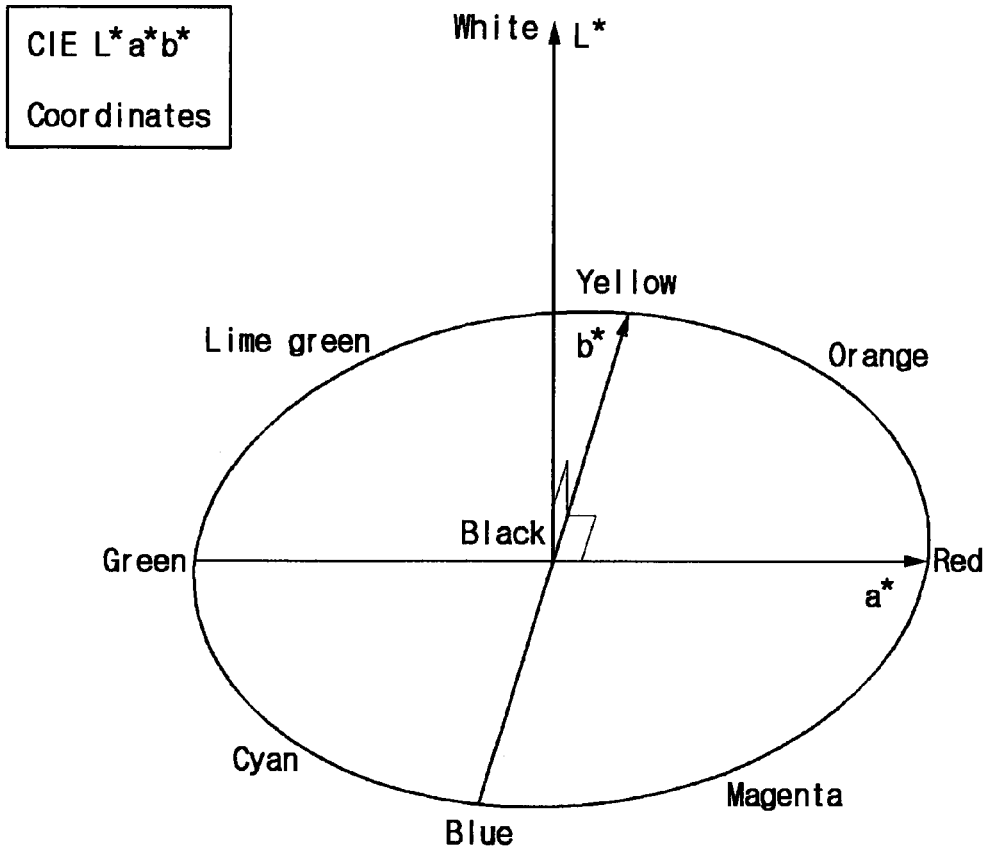
FIG. 3 is a view of CIE L*a*b* color coordinates in a color coordinate system.

FIG. 3 is a view of CIE L*a*b* color coordinates in a color coordinate system.

Referring to FIG. 3, the CIE L*a*b* is a space of which the vertical axis is L* denoting a chrominance and the horizontal plane is formed of a* and b*. As the a* value increases in a positive direction, the color grows more reddish. As the a* value increases in a negative direction, the color grows more greenish. Also, as the b* value increases in a positive direction, the color grows more yellowish, and as the b* value increases in a negative direction, the color grows more bluish. The color at the center is achromatic.

According to an embodiment of the present invention, the second dielectric layer 15 must satisfy a CIE L*a*b value condition of $70.0<L^*<74.5$, $0.0<a^*<1.0$, and $-5.0<b^*<-8.0$ to be sufficiently bluish. With the second dielectric layer having optimized brightness and chrominance, the PDP can prevent the halation effect and reduction in brightness.

The L* value is linearly proportional to the transmittance of the second dielectric layer 15. The L* value should be greater than 70% to increase the brightness of the PDP. Considering that the glass substrate of the second substrate 11 has an L* value of about 74.5, the second dielectric layer 15 should have an L* value of less than 74.5.

Also, when an a* value is less than 0, the PDP becomes reddish. When it is greater than 1, the haze or halation effect becomes so serious that it reduces the contrast of the PDP.

When a b* value is less than −5.0, the external light reflection suppressing effect of the coloring becomes small, and when the b* value is equal to or greater than 8, the bus electrode becomes more yellowish.

The kind and contents of each material for a composition for forming a dielectric layer, which will be referred to as a dielectric layer forming composition hereinafter, are controlled to satisfy the CIE L*a*b value condition, and the dielectric layer includes a glass powder composition and a coloring pigment.

The coloring pigment is included in an amount of 1.0 to 2.0 wt % based on the total weight of the dielectric layer, and includes at least one oxide selected from the group consisting of $Mn_2O_3$, NiO, CoO, CuO, and combinations thereof. According to another embodiment, the coloring pigment includes 0.27 to 0.35 wt % of $Mn_2O_3$, 0.07 to 0.15 wt % of NiO, 0.45 to 0.65 wt % of CoO, and 0.15 to 0.35 wt % of CuO. When the content of the coloring pigment is out of the range, the CIE L*a*b* value condition is not fulfilled. Thus, the aforementioned problems mentioned above when the L*a*b* value is out of the range occur.

The glass powder composition for forming the dielectric layer includes 0.5 to 1.5 parts by weight of $SiO_2$, 15 to 18 parts by weight of $B_2O_3$, 3 to 5 parts by weight of $Al_2O_3$, 40 to 43 parts by weight of $Bi_2O_3$, 13 to 16 parts by weight of BaO, and 20 to 23 parts by weight of ZnO. The amount of the glass powder composition for forming the dielectric layer is a balance amount excluding the amount of the coloring pigment from the total weight of the dielectric layer.

The second dielectric layer 15 can be prepared in a method widely known to those skilled in the art. For example, the second dielectric layer can be formed by mixing a composition, a binder, and a solvent to prepare a second dielectric layer forming a composition of a vehicle state, coating the second dielectric layer forming a composition on a substrate through a coating method, such as printing, drying, and firing at a temperature ranging from 500 to 600° C.

Examples of the binder include methyl cellulose, ethyl cellulose, nitrocellulose, hydroxymethyl cellulose, hydroxyethyl cellulose, hydroxypropyl cellulose, carboxylmethyl cellulose, carboxylethyl cellulose, carboxylethylmethyl cellulose, and combinations thereof. The binder may improve film leveling or thixotropy characteristics. According to one embodiment, ethyl cellulose may be used.

Examples of the organic solvent include at least one solvent selected from the group consisting of ethyl carbitol, butyl carbitol, ethyl carbitol acetate, butyl carbitol acetate (BCA), texanol, terpineol (TPN), dipropyleneglycol methylether, dipropyleneglycol ethylether, dipropyleneglycol monomethyl etheracetate, γ-butyrolactone, cellosolve acetate, butyl cellosolve acetate, tripropylene glycol, and combinations thereof. According to one embodiment, butyl carbitol acetate (BCA) or terpineol (TPN) may be used.

The second dielectric layer composition may further include a general additive, such as a plasticizer, a leveling agent, or a tackifier.

The plasticizer is added to give a plasticity property to the second dielectric layer forming composition, and it may be any one plasticizer selected from polypropylene glycol materials of diverse molecular weights, which are known to those skilled in the art.

The leveling agent improves a surface planarization property of a layer formed by applying the second dielectric layer forming composition onto a substrate. The leveling agent is any one agent selected from the group consisting of acryl-based leveling agents, silicon-based leveling agents, and mixtures thereof, which are commonly used by those skilled in the art of the present invention. The acryl-based leveling agent may be at least one agent selected from the group consisting of polyacrylate, a polyacrylate copolymer, polymethacrylate, and combinations thereof, and the silicon-based leveling agent may be at least one agent selected from the group consisting of polymethylalkyl siloxane, a polyester modified polymethylalkyl siloxane solution, and combinations thereof.

The tackifier provides adhesive properties between a dry film prepared using the second dielectric layer composition and a base film. The tackifier may be selected from the group consisting of generally-used ester-based and acryl-based tackifiers, and combinations thereof. The ester-based tackifier may be selected from the group consisting of rosin ester-based tackifiers, rubber rosin ester-based tackifiers, and combinations thereof. The acryl-based tackifier may be selected from the group consisting of butylacrylate-acrylic acid, ethylacrylate-hydroxy ethylacrylic acid, and combinations thereof.

In addition to the second dielectric layer 15, the barrier ribs 7 of the first substrate 1 also satisfy the CIE L*a*b* value condition that $40<L^*<50$, $1.0<a^*<2.0$, and $1.0<b^*<3.0$, and take on a brown color.

General white barrier ribs have an L value ranging from 80 to 85, an a* value ranging from −2.0 to −3.0, and a b* value ranging from −1.0 to −3.0. In the present invention, the CIE L*a*b* values are controlled by putting in a color pigment in a composition for forming the white barrier ribs. Since the L*a*b* values decrease as the firing temperature for the barrier ribs increases, the presented ranges of the L*a*b* values are the ranges that can be changed at a temperature between 500 to 600° C., which are temperatures used for general PDP fabrication processes.

The L* value is linearly proportional to the transmittance of the barrier ribs 7. Since the transmittance should be greater than 40% to increase the brightness of the PDP, the L* value must be increased.

Also, when the a* value is less than 1.0, the PDP becomes greenish. When the a* value is greater than 2.0, the PDP becomes reddish.

Also, when the b* value is less than 1.0, the PDP becomes bluish. When it is greater than 3.0, the PDP becomes yellowish.

As a result, when the L*a*b values of the barrier ribs are out of the above-noted ranges, the color of the barrier ribs does not stand in a complementary relationship with the color of the second dielectric layer. Thus, the blackening effect by the subtractive color mixing between the upper substrate and the lower substrate is reduced. In short, the lighter the color of the PDP becomes, the more the external light reflection increases. Thus, the bright room contrast ratio is reduced.

To satisfy the CIE L*a*b value condition, the kinds and contents of the materials in the barrier rib forming composition are controlled. The kinds and composition of the glass powder composition of the barrier ribs are not limited in the embodiments of the present invention, and they may be the same as the kinds and compositions of the glass powder composition for forming the conventional white barrier ribs.

A non-lead glass composition according to one embodiment includes 20 to 70 parts by weight of ZnO; 10 to 50 parts by weight of BaO; 10 to 40 parts by weight of $B_2O_3$; 0 to 20 parts by weight of $P_2O_5$; 0 to 20 parts by weight of $SiO_2$; 0 to 20 parts by weight of $Bi_2O_3$; 0 to 30 parts by weight of $V_2O_5$; 0 to 10 parts by weight of an oxide selected from the group consisting of $Na_2O$, $Li_2O$, $K_2O$, and combinations thereof; 0 to 10 parts by weight of CaO; 0 to 10 parts by weight of MgO; 0 to 30 parts by weight of SrO; 0 to 20 parts by weight of $MoO_3$; 0 to 10 parts by weight of $Al_2O_3$; 0 to 10 parts by weight of an oxide selected from the group consisting of $Sb_2O_3$, CuO, $Cr_2O_3$, $As_2O_3$, CoO, NiO, and combinations thereof; and 0 to 10 parts by weight of $TiO_2$.

A non-lead glass composition according to another embodiment includes 30 to 45 parts by weight of ZnO; 10 to 25 parts by weight of BaO; 20 to 35 parts by weight of $B_2O_3$; 5 to 20 parts by weight of $P_2O_5$; 0 to 20 parts by weight of $SiO_2$; 0 to 20 parts by weight of $Bi_2O_3$; 0 to 30 parts by weight of $V_2O_5$; 0 to 10 parts by weight of an oxide selected from the group consisting of $Na_2O$, $Li_2O$, $K_2O$, and combinations thereof; 0 to 10 parts by weight of CaO; 0 to 10 parts by weight of MgO; 0 to 30 parts by weight of SrO; 0 to 20 parts by weight of $MoO_3$; 0 to 10 parts by weight of an oxide selected from the group consisting of $Sb_2O_3$, CuO, $Cr_2O_3$, $As_2O_3$, CoO, NiO, and combinations thereof; 0 to 10 parts by weight of $Al_2O_3$; and 0 to 10 parts by weight of $TiO_2$.

A non-lead glass composition according to another embodiment includes 30 to 45 parts by weight of ZnO; 10 to 25 parts by weight of BaO; 20 to 35 parts by weight of $B_2O_3$; 5 to 20 parts by weight of $P_2O_5$; 0 to 2 parts by weight of $Na_2O$; 0 to 2 parts by weight of $Li_2O$; and 0 to 2 parts by weight of $TiO_2$.

A non-lead glass composition according to another embodiment includes 5 to 21 parts by weight of ZnO; 5 to 31 parts by weight of $B_2O_3$; 34 to 85 parts by weight of $Bi_2O_3$; 0 to 19 parts by weight of $SiO_2$; 0 to 9 parts by weight of $Al_2O_3$; 0 to 15 parts by weight of an oxide selected from the group consisting of $Na_2O$, $Li_2O$, $K_2O$, and combinations thereof; 0 to 20 parts by weight of an oxide selected from the group consisting of CaO, BaO, MgO, SrO, and combinations thereof; and 0 to 9 parts by weight of $ZrO_2$.

A non-lead glass composition according to another embodiment includes 39 to 66 parts by weight of ZnO; 5 to 35 parts by weight of $Bi_2O_3$; 5 to 33 parts by weight of $B_2O_3$; 2 to 15 weight of $SiO_2$; 0 to 15 parts by weight of an oxide selected from the group consisting of $Na_2O$, $Li_2O$, $K_2O$, and combinations thereof; and 0 to 20 parts by weight of an oxide selected from the group consisting of CaO, BaO, MgO, SrO, and combinations thereof.

A non-lead glass composition according to another embodiment includes 10 to 41 parts by weight of ZnO; 5 to 41 parts by weight of $B_2O_3$; 5 to 35 parts by weight of $Bi_2O_3$; 0 to 10 parts by weight of $SiO_2$; 0 to 15 parts by weight of an oxide selected from the group consisting of $Na_2O$, $Li_2O$, $K_2O$, and combinations thereof; 0 to 20 parts by weight of an oxide selected from the group consisting of CaO, BaO, MgO, SrO, and combinations thereof; and 45 to 72 parts by weight of $P_2O_5$.

In the non-lead glass compositions according to the above-noted embodiments, 0 parts by weight represents an outside limit of the corresponding components. The optional components may be included in an amount which is greater than or equal to 0.01 parts by weight with respect to the non-lead glass compositions. The amount of the glass powder composition for forming the barrier ribs is a balance amount excluding the coloring pigment of the total weight of the barrier ribs.

The coloring pigment for the barrier ribs may be selected from the group consisting of $TiO_2$, $MnO_2$, $SbO_2$, (Ti, Mn, Sb)$O_2$, (Cu, Cr)$O_2$, and combinations thereof. According to one embodiment, the (Cu, Cr)$O_2$ may include $CuCr_2O_2$.

The coloring pigment may be included in an amount which is less than or equal to 1 wt % Xs based on the total weight of the barrier ribs. According to another embodiment, the coloring pigment may be included in an amount in a range of 0.1 to 1.0 wt % based on the total weight of the barrier ribs. When the content of the coloring pigment is out of the range, the blackening based on the color complementary relationship between the barrier ribs 7 and the second dielectric layer 15 can not realized.

The barrier ribs 7 of the present embodiment may be fabricated in a method widely known to those skilled in the art. For example, a barrier rib forming composition is prepared by mixing a glass powder composition for forming the barrier ribs, the coloring pigment, the binder, and the organic solvent. Then, a substrate is coated with the barrier rib forming composition, dried, and fired at a temperature of 500 to 600° C.

The binder and the solvent are the same as those mentioned in the description of the second dielectric layer 15.

The barrier ribs are fabricated in a known method, such as screen printing, sanding, etching, adding, and stamping. For example, the barrier ribs are fabricated by applying the barrier rib forming composition to a substrate in a thickness of 300 to 400 μm, firing them at a temperature ranging from 530 to 570° C., attaching an anti-acidic tape to the fired substrate, and chemically etching the substrate with an acidic etching solution.

The barrier ribs 7 may be formed in any shape as long as their shape can partition the discharge space, and the barrier ribs 7 have diverse patterns. For example, the barrier ribs 7 may be formed as an open type, such as stripes, or as a closed type, such as a waffle, matrix, or delta shape. Also, the closed-type barrier ribs may be formed such that a horizontal cross-section of the discharge space is a polygon, such as a quadrangle, triangle, or pentagon, or a circle or oval. The closed-type barrier ribs may have a step in which the height of the horizontal axis is lower than the height of the vertical axis.

The complementary color effect between the barrier ribs and the second dielectric layer, which is acquired in the embodiments of the present invention, is not affected by the shape of the barrier ribs. However, since the inside of the barrier ribs is filled with the phosphor, the barrier ribs are designed to have the width of the upper part of the barrier ribs to be greater than or smaller than the width of the lower part so that the upper part of the barrier ribs are more exposed to thereby reduce the external light reflection brightness. The width of the upper part of the barrier ribs is between 30 and 60 μm in consideration of the discharge space and the barrier rib fabrication process.

As described above, the PDP of the present embodiments has the second dielectric layer with optimized brightness and chrominance to thereby prevent degradation of brightness and haze formation. In addition, the PDP of the present embodiments can have a remarkably improved bright room contrast ratio of 120:1 to more than 150:1, by using brown-colored barrier ribs to reduce the external light reflection brightness of the PDP to 8 cd/$m^2$ based on the color complementary relationship between the second dielectric layer and the barrier ribs. A conventional PDP that does not use the color complementary relationship has a bright room contrast ratio of about 65:1. When a front filter is disposed in the front part of the PDP, the bright room contrast ratio of the PDP suggested in the present embodiments increases to a level ranging from 300:1 to 500:1. The resulting figures may differ according to how the bright room contrast ratio is measured. However, the results still exemplify a reduced external light reflection and improved bright room contrast ratio in the PDP of the present embodiment.

The following examples illustrate the present invention in more detail. However, it is understood that the present invention is not limited by these examples.

Example 1

Fabrication of a Rear Panel

Address electrodes were formed by coating a rear substrate formed of soda lime glass with silver (Ag) paste and patterning the rear substrate. Subsequently, the entire surface of the rear substrate with the address electrodes formed thereon was coated with a dielectric layer forming composition and fired to thereby form a brown-colored dielectric layer.

Barrier ribs were formed of a glass composition on the dielectric layer. Subsequently, a red phosphor layer was formed of (Y, Gd)$BO_3$:Eu, a blue phosphor layer was formed of $BaMgAl_{10}O_{17}$:Eu, and a green phosphor layer was formed of $ZnSiO_4$:Mn in a region partitioned by the barrier ribs to thereby complete the fabrication of the rear panel.

Fabrication of a Front Panel

Display electrodes including indium tin oxide transparent electrodes and silver bus electrodes were formed in the shape of stripes in a conventional method on the front substrate formed of soda lime glass. Subsequently, the entire surface of the substrate with the display electrodes was coated with a dielectric layer forming composition and fired to thereby form a blue-colored dielectric layer.

The dielectric layer forming composition was prepared by mixing a transparent glass composition including $SiO_2$ at 1.0 wt %, $B_2O_3$ at 18 wt %, $Al_2O_3$ at 3 wt %, $Bi_2O_3$ at 41 wt %, BaO at 15 wt %, and ZnO at 21 wt %, a coloring pigment $Mn_2O_3$ at 0.30 wt %; a glass composition including NiO at 0.1 wt %, CoO at 0.5 wt %, and CuO at 0.2 wt %; an ethylcellulose binder; and an a-terpineol solvent. The substrate was coated with the dielectric layer forming composition to a thickness of 200 μm, dried, and fired at 550° C. to thereby form a dielectric layer.

Subsequently, a MgO protective layer was formed through ion plating to thereby form a MgO protective layer on the dielectric layer. In this way, the fabrication of the rear panel was completed.

Fabrication of PDP

The front panel and the rear panel were disposed to face each other and sealed by using a glass composition for sealing. The air in the space between the front panel and the rear panel was exhausted, and the PDP was thereby fabricated.

Example 2

A barrier rib forming composition was prepared by mixing a non-lead glass composition including ZnO at 10 wt %, $SiO_2$ at 8.0 wt %, $B_2O_3$ at 22 wt %, $Al_2O_3$ at 3 wt %, $Na_2O$ at 0.5 wt %, $K_2O$ at 0.5 wt %, $Li_2O$ at 0.5 wt %, CaO at 1.0 wt %, BaO at 1.0 wt %, MgO at 1.0 wt %, SrO at 1.0 wt %, 9 $ZrO_2$ at 5.0 wt %, and $Bi_2O_3$ at 45.5 wt %; and a coloring pigment composition including $TiO_2$ at 0.5 wt % and $CuCr_2O_2$ at 0.5 wt %.

Ethylcellulose was used as a binder, and a-terpineol was used as a solvent. A substrate was coated with the barrier rib forming composition to a thickness of 500 μm, dried, fired at 550° C., and etched to thereby form barrier ribs.

A PDP was fabricated in the same method as in Example 1, except that the barrier rib forming composition of the above-described composition was used.

Comparative Example 1

A PDP was fabricated including a dielectric layer, which was formed using a dielectric layer forming composition without a coloring pigment and a barrier rib forming composition without a coloring pigment, by performing the same procedure as in Example 1.

Comparative Example 2

A PDP was fabricated by using a coloring pigment only in the barrier rib forming composition.

Comparative Example 3

A PDP was fabricated by the same method as in Example 1, except that $RuO_2$ as a dark pigment was added to the dielectric layer forming composition, instead of a coloring pigment.

Experimental Example 1

The CIE L*a*b* values of the dielectric layer and barrier ribs of the front panels fabricated according to Examples 1 and 2 and Comparative Examples 1 and 2 were measured and are presented in the following Table 1.

TABLE 1

| | | Example 1 | Example 2 | Comparative Example 1 | Comparative Example 2 |
|---|---|---|---|---|---|
| Dielectric layer | L*a*b* | L = 72<br>a* = 0.5<br>b* = −3.0 | L = 72<br>a* = 0.5<br>b* = −3.0 | L = 72<br>a* = 0.1<br>b* = −6.0 | L = 72<br>a* = 0.1<br>b* = −6.0 |
| | Color | Blue | Blue | White | White |
| Barrier rib | L*a*b* | L = 82<br>a* = −2.0<br>b* = −2.0 | L = 45<br>a* = 1.5<br>b* = 2.0 | L = 82<br>a* = −2.0<br>b* = −2.0 | L = 45<br>a* = 1.5<br>b* = 2.0 |
| | Color | White | Brown | White | Brown |

Experimental Example 2

The extent of blackening in the front panel of the PDP fabricated according to Example 2 was evaluated to determine the color complementary relationship based on the subtractive mixing.

Figure 4:
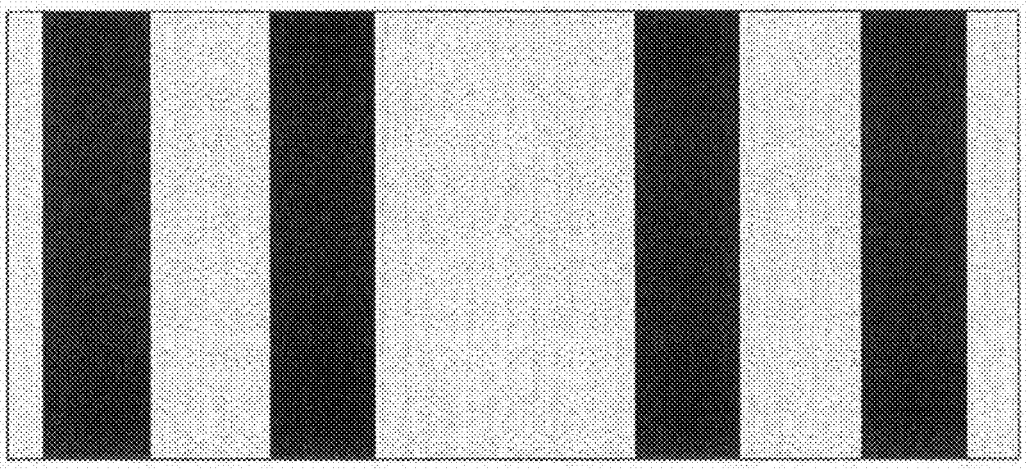
FIG. 4 is a view of a bus electrode pattern of the PDP of Example 2.

FIG. 4 shows a bus electrode pattern of the PDP of Example 2. The drawing shows that the bus electrode pattern is black. The result shows that the PDP of Example 2 can reduce external light reflection and improve the bright room contrast ratio.

Experimental Example 3

The external light reflection of the PDP fabricated according to Example 2 and Comparative Examples 1 and 3 was measured.

The result was that the PDP of Comparative Example 1 showed external light reflection brightness of 16 to 18 cd/$m^2$, whereas the PDP of Comparative Example 3 including a dark pigment showed an external light reflection brightness of 12 to 13 cd/$m^2$. Moreover, the brightness of the PDP of Comparative Example 3 was drastically deteriorated.

In comparison, the PDP of Example 2, which was suggested in the present invention, did not have the brightness decrease while having a remarkably reduced bright room contrast ratio by reducing the external light reflection brightness to 8 cd/$m^2$.

As described above, the use of the second dielectric layer with optimal brightness and chrominance suggested in the present invention prevents haze deterioration as well as brightness deterioration. When the brown-colored barrier ribs are used, the PDP can reduce the external light reflection and improve the bright room contrast based on the color complementary relationship between the second dielectric layer and the barrier ribs to thereby realize a high-quality image.

While this invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A Plasma Display Panel (PDP) comprising:

a first substrate and a second substrate that are arranged in parallel with each other with a predetermined distance therebetween;

a plurality of address electrodes arranged on the first substrate;

a first dielectric layer arranged to cover the address electrodes;

a plurality of barrier ribs having a predetermined height from the first dielectric layer to define discharge cells;

red, blue, and green phosphor layers respectively arranged in the discharge cells;

a plurality of display electrodes arranged on one side of the second substrate facing the first substrate in a direction crossing the address electrodes;

a second dielectric layer arranged to cover the display electrodes; and a protective layer arranged to cover the second dielectric layer;

wherein the second dielectric layer satisfies values of CIE L*a*b* where $70.0<L^*<74.5$, $0.0<a^*<1.0$, and $-5.0<b^*<-8.0$, and wherein the second dielectric layer comprises a glass powder composition to form the dielectric layer and a coloring pigment, the coloring pigment comprising 0.27 to 0.35 wt % of $Mn_2O_3$, 0.07 to 0.15 wt % of NiO, and 0.45 to 0.65 wt % of CoO.

2. The PDP of claim 1, wherein the coloring pigment is included in an amount in a range of 1.0 to 2.0 wt % based on the total weight of the dielectric layer.

3. The PDP of claim 2, wherein the coloring pigment further comprises CuO.

4. The PDP of claim 2, wherein the coloring pigment further comprises 0.15 to 0.35 wt % of CuO.

5. The PDP of claim 2, wherein the glass powder composition to form the dielectric layer comprises 0.5 to 1.5 parts by weight of $SiO_2$, 15 to 18 parts by weight of $B_2O_3$, 3 to 5 parts by weight of $Al_2O_3$, 40 to 43 parts by weight of $Bi_2O_3$, 13 to 16 parts by weight of BaO, and 20 to 23 parts by weight of ZnO.

6. The PDP of claim 1, wherein the barrier ribs satisfy values of CIE L*a*b* where $40<L^*<50$, $1.0<a^*<2.0$, and $1.0<b^*<3.0$.

7. The PDP of claim 1, wherein the barrier ribs comprise a glass powder composition to form the barrier ribs and a coloring pigment for the barrier ribs, and wherein the coloring pigment for the barrier ribs is included in an amount less than or equal to 1 wt % based on the total weight of the barrier ribs.

8. The PDP of claim 7, wherein the coloring pigment for the barrier ribs is in an amount in a range of 0.1 to 1.0 wt % based on the total weight of the barrier ribs.

9. The PDP of claim 7, wherein the coloring pigment for the barrier ribs comprises at least one pigment selected from the group consisting of $TiO_2$, $MnO_2$, $SbO_2$, $(Ti,Mn,Sb)O_2$, $(Cu, Cr)O_2$, and combinations thereof.

10. The PDP of claim 7, wherein the glass powder composition to form the barrier ribs comprises at least one composition selected from the group consisting of:

a non-lead glass composition including 20 to 70 parts by weight of ZnO, 10 to 50 parts by weight of BaO, 10 to 40 parts by weight of $B_2O_3$, 0 to 20 parts by weight of $P_2O_5$, 0 to 20 parts by weight of $SiO_2$, 0 to 20 parts by weight of $Bi_2O_3$, 0 to 30 parts by weight of $V_2O_5$, 0 to 10 parts by weight of an oxide selected from the group consisting of $Na_2O$, $Li_2O$, $K_2O$, and combinations thereof, 0 to 10 parts by weight of CaO, 0 to 10 parts by weight of MgO, 0 to 30 parts by weight of SrO, 0 to 20 parts by weight of $MoO_3$, 0 to 10 parts by weight of $Al_2O_3$, 0 to 10 parts by weight of an oxide selected from the group consisting of $Sb_2O_3$, CuO, $Cr_2O_3$, $As_2O_3$, CoO, NiO, and combinations thereof, and 0 to 10 parts by weight of $TiO_2$, a non-lead glass composition including 30 to 45 parts by weight of ZnO, 10 to 25 parts by weight of BaO, 20 to 35 parts by weight of $B_2O_3$, 5 to 20 parts by weight of $P_2O_5$, 0 to 20 parts by weight of $SiO_2$, 0 to 20 parts by weight of $Bi_2O_3$, 0 to 30 parts by weight of $V_2O_5$, 0 to 10 parts by weight of an oxide selected from the group consisting of $Na_2O$, $Li_2O$, $K_2O$, and combinations thereof, 0 to 10 parts by weight of CaO, 0 to 10 parts by weight of MgO, 0 to 30 parts by weight of SrO, 0 to 20 parts by weight of $MoO_3$, 0 to 10 parts by weight of an oxide selected from the group consisting of $Sb_2O_3$, CuO, $Cr_2O_3$, $As_2O_3$, CoO, NiO, and combinations thereof, 0 to 10 parts by weight of $Al_2O_3$, and 0 to 10 parts by weight of $TiO_2$, a non-lead glass composition including 30 to 45 parts by weight of ZnO, 10 to 25 parts by weight of BaO, 20 to 35 parts by weight of $B_2O_3$, 5 to 20 parts by weight of $P_2O_5$, 0 to 2 parts by weight of $Na_2O$, 0 to 2 parts by weight of $Li_2O$, and 0 to 2 parts by weight of $TiO_2$, a non-lead glass composition including 5 to 21 parts by weight of ZnO, 5 to 31 parts by weight of $B_2O_3$, 34 to 85 parts by weight of $Bi_2O_3$, 0 to 19 parts by weight of $SiO_2$, 0 to 9 parts by weight of $Al_2O_3$, 0 to 15 parts by weight of an oxide selected from the group consisting of $Na_2O$, $Li_2O$, $K_2O$, and combinations thereof, 0 to 20 parts by weight of an oxide selected from the group consisting of CaO, BaO, MgO, SrO, and combinations thereof, and 0 to 9 parts by weight of $ZrO_2$;

a non-lead glass composition including 39 to 66 parts by weight of ZnO, 5 to 35 parts by weight of $Bi_2O_3$, 5 to 33 parts by weight of $B_2O_3$, 2 to 15 weight of $SiO_2$, 0 to 15 parts by weight of an oxide selected from the group consisting of $Na_2O$, $Li_2O$, $K_2O$, and combinations thereof, and 0 to 20 parts by weight of an oxide selected from the group consisting of CaO, BaO, MgO, SrO, and combinations thereof; and a non-lead glass composition including 10 to 41 parts by weight of ZnO, 5 to 41 parts by weight of $B_2O_3$, 5 to 35 parts by weight of $Bi_2O_3$, 0 to 10 parts by weight of $SiO_2$, 0 to 15 parts by weight of an oxide selected from the group consisting of $Na_2O$, $Li_2O$, $K_2O$, and combinations thereof, 0 to 20 parts by weight of an oxide selected from the group consisting of CaO, BaO, MgO, SrO, and combinations thereof, and 45 to 72 parts by weight of $P_2O_5$.

11. The PDP of claim 1, comprising an external light reflection brightness of less than or equal to 8 cd/$m^2$.

* * * * *